US006113663A

United States Patent [19]

Liu

[11] Patent Number: 6,113,663

[45] Date of Patent: Sep. 5, 2000

[54] VACUUM CLEANER HAVING A DUAL FILTER ASSEMBLY

[75] Inventor: Li H. Liu, Tucson, Ariz.

[73] Assignee: Shop Vac Corporation, Williamsport, Pa.

[21] Appl. No.: 09/189,755

[22] Filed: Nov. 10, 1998

[51] Int. Cl.[7] ..... B01D 45/12

[52] U.S. Cl. ..... 55/459.1; 55/472; 55/476; 55/DIG. 3; 96/321; 96/406

[58] Field of Search ..... 55/472, 476, 490, 55/498, 510, DIG. 3, 459.1, 465; 210/232, 450; 96/321, 406; 15/353

[56] References Cited

U.S. PATENT DOCUMENTS

| | | | |
|---|---|---|---|
| 1,316,442 | 9/1919 | Goughnour . | |
| 1,639,133 | 8/1927 | Greene . | |
| 2,475,808 | 7/1949 | Storm, Jr. . | |
| 2,663,660 | 12/1953 | Layte . | |
| 2,785,767 | 3/1957 | Glidden . | |
| 3,186,391 | 6/1965 | Kennedy . | |
| 3,290,870 | 12/1966 | Jensen . | |
| 3,365,864 | 1/1968 | Iizima . | |
| 3,397,793 | 8/1968 | MacDonnell . | |
| 3,399,516 | 9/1968 | Hough, Jr. et al. . | |
| 3,488,928 | 1/1970 | Tarala . | |
| 3,820,310 | 6/1974 | Fromknecht et al. | 55/DIG. 3 |
| 3,870,486 | 3/1975 | Erikson et al. | 55/DIG. 3 |
| 3,909,219 | 9/1975 | Fromknecht | 55/DIG. 3 |
| 3,930,281 | 1/1976 | Principe et al. . | |
| 4,080,104 | 3/1978 | Brown, Jr. . | |
| 4,120,711 | 10/1978 | Gudeman . | |
| 4,268,289 | 5/1981 | Polaner . | |
| 4,297,114 | 10/1981 | Hutchins | 55/DIG. 3 |
| 4,304,580 | 12/1981 | Gehl et al. . | |
| 4,314,832 | 2/1982 | Fox . | |
| 4,508,550 | 4/1985 | Berfield et al. . | |
| 4,547,206 | 10/1985 | Sovis et al. . | |
| 4,609,387 | 9/1986 | Berfield et al. | 55/DIG. 3 |
| 4,619,674 | 10/1986 | Erdmannsdörfer . | |
| 4,619,675 | 10/1986 | Watanabe . | |
| 4,623,366 | 11/1986 | Berfield et al. . | |
| 4,647,373 | 3/1987 | Tokar et al. . | |
| 4,654,926 | 4/1987 | McCambridge . | |
| 4,800,612 | 1/1989 | Valentine . | |
| 4,800,613 | 1/1989 | Blase et al. . | |
| 4,800,615 | 1/1989 | Ostroski et al. . | |
| 4,801,376 | 1/1989 | Kulitz . | |
| 4,809,396 | 3/1989 | Houser . | |
| 4,826,597 | 5/1989 | Silverwater et al. . | |
| 4,838,907 | 6/1989 | Perry . | |
| 4,861,479 | 8/1989 | Solzer . | |
| 4,878,929 | 11/1989 | Tofsland et al. . | |
| 4,886,599 | 12/1989 | Bachmann et al. . | |
| 4,890,444 | 1/1990 | Vander Giessen et al. . | |
| 4,894,881 | 1/1990 | Palmer et al. . | |
| 4,906,265 | 3/1990 | Berfield . | |
| 4,957,522 | 9/1990 | Brassell . | |
| 4,976,850 | 12/1990 | Kulitz . | |
| 4,976,858 | 12/1990 | Kadoya . | |
| 5,032,155 | 7/1991 | Wiese et al. . | |
| 5,080,697 | 1/1992 | Finke . | |
| 5,185,190 | 2/1993 | Grimes . | |
| 5,193,709 | 3/1993 | Brassell . | |
| 5,205,014 | 4/1993 | Yoo . | |
| 5,248,323 | 9/1993 | Stevenson . | |
| 5,259,854 | 11/1993 | Newman | 55/DIG. 3 |
| 5,267,371 | 12/1993 | Soler et al. . | |
| 5,287,591 | 2/1994 | Rench et al. . | |
| 5,343,592 | 9/1994 | Parise . | |

(List continued on next page.)

OTHER PUBLICATIONS

Liu, U.S. Patent Application Serial No. 09/143,980, filed Aug. 31, 1998.

*Primary Examiner*—David A. Simmons
*Assistant Examiner*—Minh-Chau T. Pham
*Attorney, Agent, or Firm*—Marshall, O'Toole, Gerstein, Murray & Borun

[57] ABSTRACT

A vacuum cleaner having a dual filter assembly includes a filter cage, a primary filter disposed on the filter cage, and a secondary filter disposed downstream of the primary filter. A float valve between the primary filter and the secondary filter inhibits liquid from coming into contact with the secondary filter.

11 Claims, 5 Drawing Sheets

U.S. PATENT DOCUMENTS 5,350,515 9/1994 Stark et al. .
5,388,301 2/1995 Bosyj et al. .
5,394,587 3/1995 Parise .
5,455,983 10/1995 Crouser et al. .
5,478,372 1/1999 Berfield ..... 55/DIG. 1
5,545,241 8/1996 Vanderauwera et al. .
5,570,489 11/1996 Lee .
5,593,479 1/1997 Frey et al. .
5,608,945 3/1997 Crouser et al. .
5,669,949 9/1997 Dudrey et al. .
5,672,399 9/1997 Kahlbaugh et al. .
5,733,351 3/1998 Hult et al. .
5,855,634 1/1999 Berfield .
5,954,863 9/1999 Loveless et al. ..... 96/321

VACUUM CLEANER HAVING A DUAL FILTER ASSEMBLY

FIELD OF THE INVENTION

The present invention relates generally to vacuum cleaners, and more particularly to filters for vacuum cleaners.

BACKGROUND OF THE INVENTION

Vacuum cleaners generally include a motor which drives an air impeller to create a low pressure area inside of a tank or other receptacle. The tank has an inlet through which dust and debris or liquid material enter into the tank, usually from a hose. When liquid is being suctioned into the tank, it is not generally necessary to have a filter between the tank and the air impeller. For instance, in U.S. Pat. No. 4,906,265, a foam cuff 30 fits over a filter cage 20 during wet operations. When the vacuum cleaner is used on dry materials, a paper or cloth filter is placed over the foam cuff and attached with a ring. The paper or cloth filter then minimizes the amount of particulate material which escapes from the tank and passes to the air impeller. Dust or debris in the air impeller is undesirable because it may interfere with the operation of the air impeller or motor, and the dust or debris may be exhausted back out into the room.

While cloth or flat paper filters may be satisfactory, it is often desirable to use a cylindrical pleated filter for some types of vacuuming. Cylindrical or cartridge filters have a large filtering surface area and may be made of a variety of filtering materials. It has therefore been known to use a cylindrical filter with an open top and a closed bottom which is inserted over a filter cage. The top of the filter may be made of a flexible material such as rubber so that when the filter is pushed over the filter cage, the flexible material deforms and frictionally holds the filter in place.

Other systems use cylindrical filters which are open at both ends. Such filters may fit over a filter cage having a closed bottom in order to prevent material from passing around the filter and into the air impeller. Other open-ended filters may use a retainer of some type which holds the filter in place and closes the open end of the filter.

Dual filter assemblies may include two types of filter media concentrically arranged in a single filter unit, such as that disclosed in Newman, U.S. Pat. No. 5,259,854. High efficiency particle air ("HEPA") filters, which can remove 99.97% of particles larger than 0.3 microns from a stream of air, are useful for removing very small particles of dust or debris from air. Newman discloses a disposable filter cannister including an annular HEPA filter surrounded by a prefilter. There is a need for a dual filter assembly in which each of the filters can be separately removed for inspection and replacement, and in which one or both filters may be used. There is a also a need for a vacuum cleaner having a dual filter assembly in which a secondary filter, such as a HEPA filter, is protected from moisture.

SUMMARY OF THE INVENTION

In accordance with one aspect of the present invention, a vacuum cleaner having a dual filter assembly includes a filter support, a primary filter disposed on the filter support, and a secondary filter disposed downstream of the primary filter. A valve inhibits liquid from coming into contact with the secondary filter.

The filter support may be a filter cage and the valve may be a float valve. The secondary filter may be disposed on a second filter support or in a cage base removably attached to a tank lid. The cage base may be attached to the tank lid by a plurality of clamps and can be disposed between the filter support and the tank lid.

The vacuum cleaner may also include a filter retainer for retaining the primary filter on the filter support. The secondary filter may be a HEPA filter. The valve may be upstream the secondary filter and downstream the primary filter. The valve may include a float ball disposed in the filter cage.

In accordance with another aspect of the invention a wet/dry vacuum cleaner includes a first filter cage, a cage base attached to the first filter cage, and a primary filter disposed on the filter cage. A secondary filter is disposed on a second filter cage, inside of the cage base, and downstream of the primary filter. A float ball is disposed inside of the first filter cage for preventing liquid from coming into contact with the secondary filter.

Other objects and advantages of the invention will be apparent to those skilled in the art from a review of the following detailed description, taken in conjunction with the drawings and the appended claims.

DETAILED DESCRIPTION OF THE PREFERRED EMBODIMENT

Figure 1:
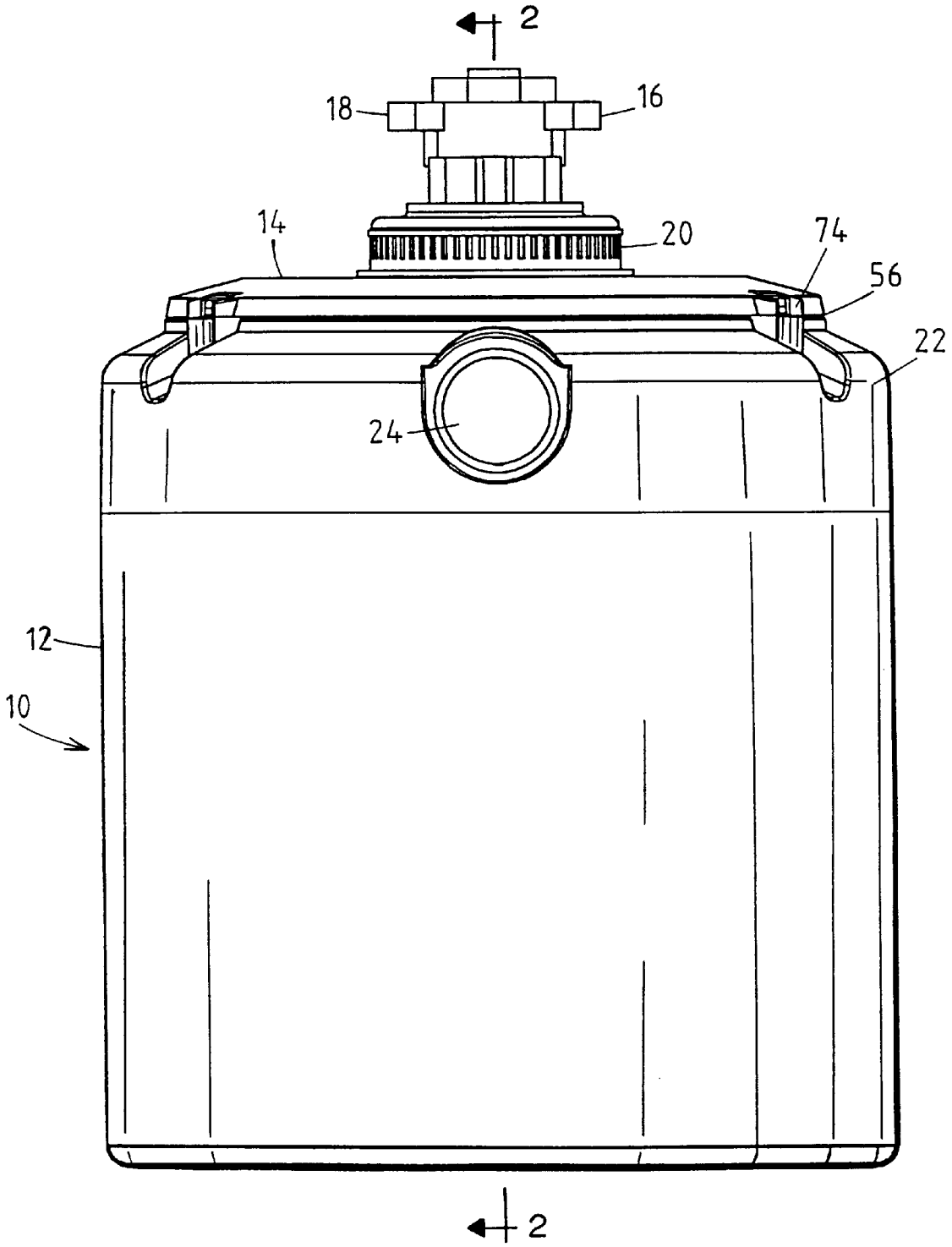
FIG. 1 is an elevational view of a vacuum cleaner having a dual filter assembly of the present invention.

Referring initially to FIG. 1, a vacuum cleaner 10, which can be a wet/dry vacuum cleaner, includes a tank 12 to which a lid 14 is attached. A motor/impeller unit 16 having a motor 18 and an impeller 20 is attached to the lid 14. The tank 12 includes a rim 22 and an air inlet 24 through which air is drawn by the motor/impeller unit 16. Typically, a housing (not shown) covers the motor/impeller unit 16.

Figure 2:
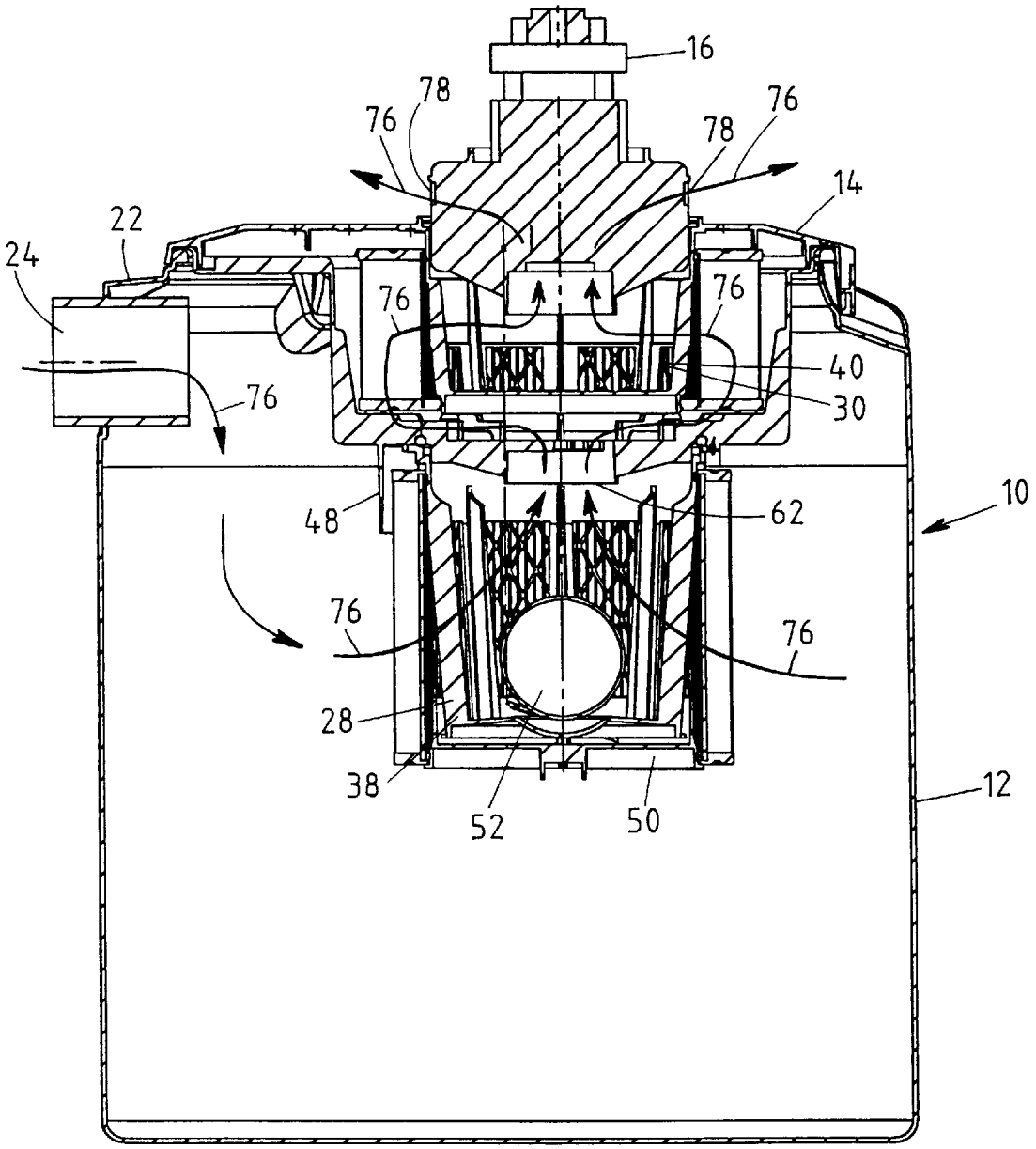
FIG. 2 is a cross-sectional view of a vacuum cleaner taken generally along line 2—2 of FIG. 1.
Figure 3:
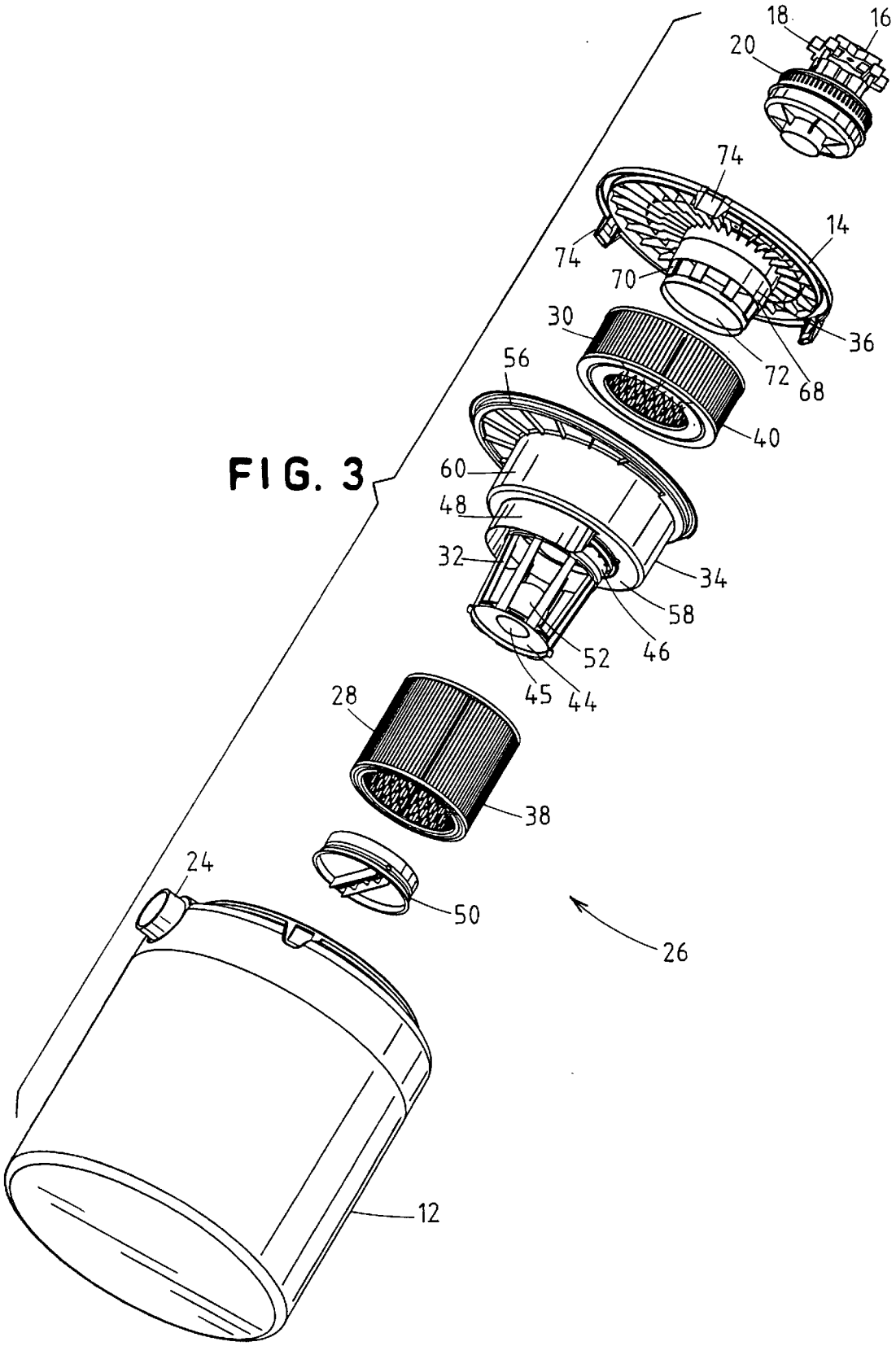
FIG. 3 is an exploded perspective view of the vacuum cleaner of FIG. 1.

As shown in FIGS. 2—3, a dual filter assembly indicated generally at 26 includes a primary filter 28, a secondary filter 30, a first filter support such as a filter cage 32, a filter support base (or cage base) 34, and a second filter support such as a filter cage 36. The dual filter assembly 26 is disposed inside of the tank 12. Typically, the filters 28, 30 have an annular shape with an open top and bottom. The primary filter 28 includes a filter medium 38 and the secondary filter 30 includes a filter medium 40. Typically the filter media 38, 40 are in a pleated configuration, and may be made from paper, non-woven polyester, or non-woven polypropylene. If non-woven polyester is used it may comprise melt-blown or spun-bonded polyester, or a combination of melt-blown and spun-bonded polyester. Likewise, if non-woven polypropylene is used, it may comprise melt-blown or spun-bonded polypropylene, or a combination of melt-blown and spun-bonded polypropylene. Preferably, the secondary filter 30 comprises a HEPA filter medium 40.

Figure 5:
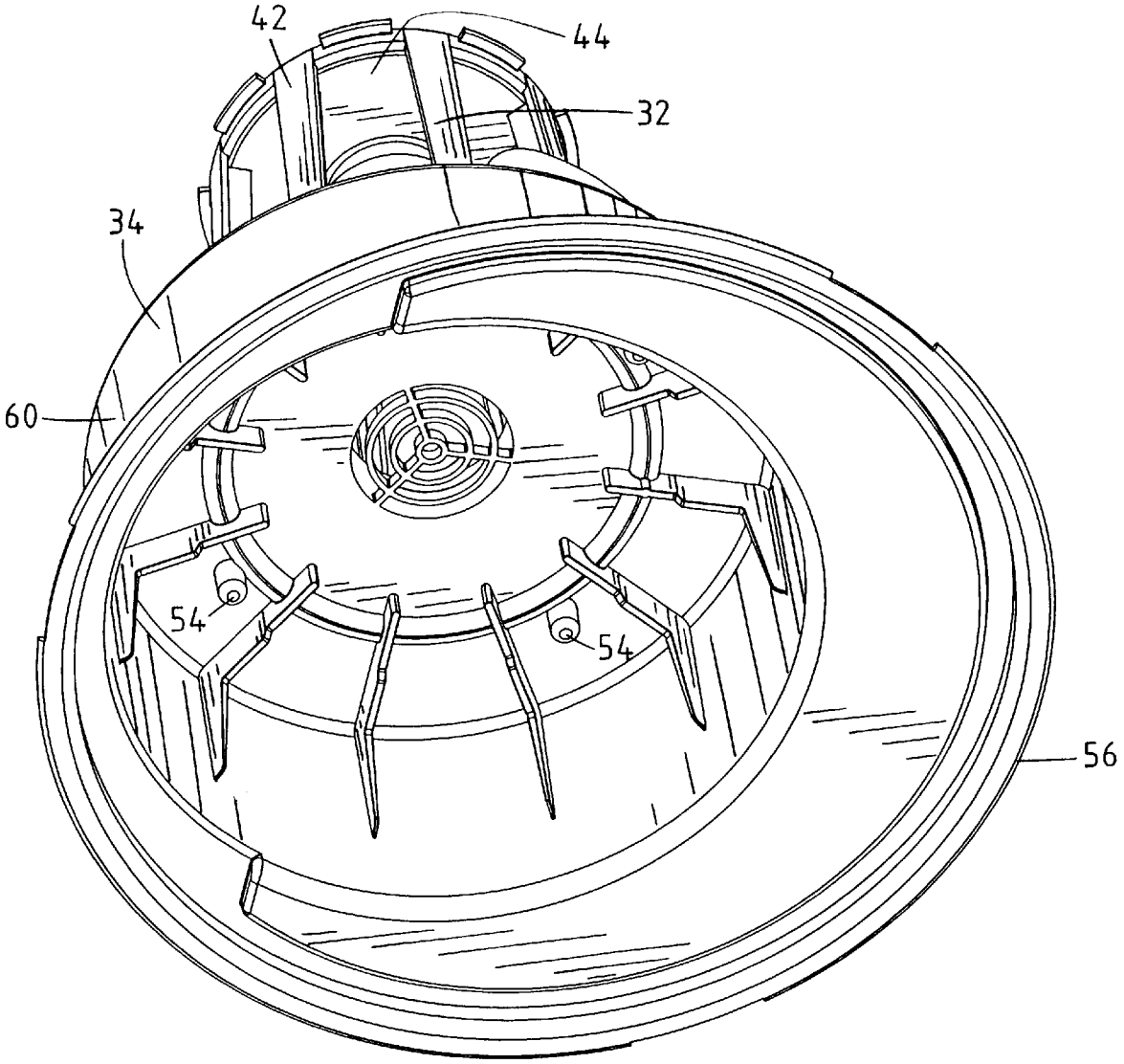
FIG. 5 is a perspective view of a filter cage and cage base.

As shown in FIGS. 2–3 and 5, the primary filter 38 fits on the filter cage 32, which includes side ribs 42, a bottom plate 44 with an opening 45, and a rim 46. The primary filter 38 fits between the filter cage 32 and a deflector shield 48. The primary filter 28 is held in position by a filter retainer or cap 50, which is described in more detail in U.S. patent application Ser. No. 08/881,423 and U.S. patent application Ser. No. 09/143,980, the disclosures of which are hereby incorporated by reference. A float ball 52 is disposed inside of the filter cage 32.

The filter cage 32 is attached to the cage base 34 in a conventional manner, such as by a screws 54 (FIG. 5), after the float ball 52 is placed in the filter cage 32. The cage base includes a lip 56, a bottom plate 58, and an annular side wall 60. As shown in FIG. 2, the bottom plate 58 includes a float valve orifice 62. The float ball 52 together with the float valve orifice 62 comprise a float valve 64.

Figure 4:
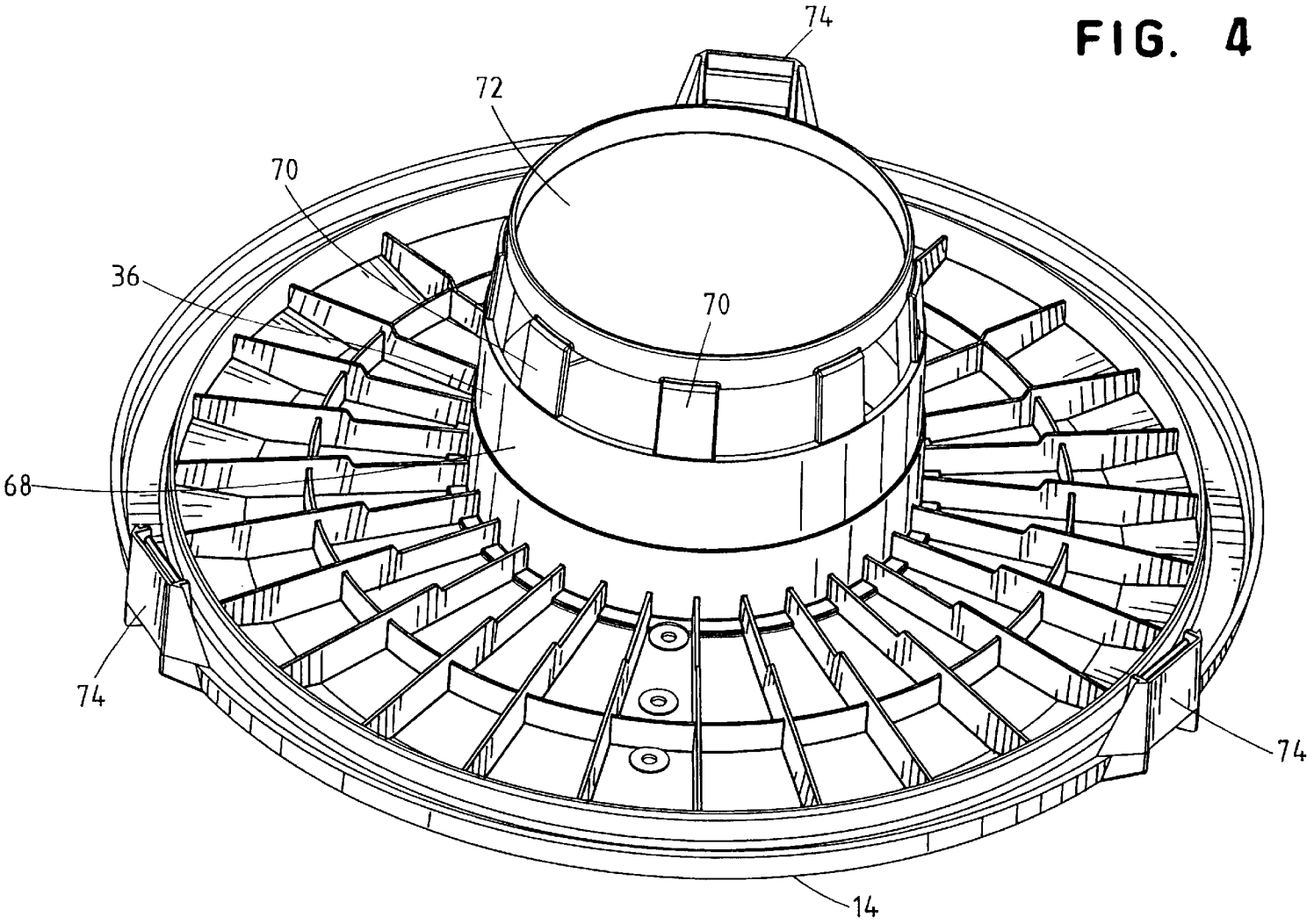
FIG. 4 is a perspective view of a tank lid.

The secondary filter 30 fits inside of the cage base 34 and fits on the filter cage 36 (FIG. 4), which includes a rim 68, side ribs 70, and a bottom plate 72. The filter cage 36 is attached to the tank lid 14 in a conventional manner. To assemble the vacuum cleaner 10 including the dual filter assembly 26, the primary filter 28 is placed around the filter cage 32 and held in position by the filter retainer 50. The secondary filter 30 is placed on the filter cage 36 and inside of the cage base 34. The lip 56 of the cage base is placed on the tank rim 22, and the tank lid 14 is attached to the tank 12 by clamps 74. In this manner, the lip 56 of the cage base 34 is sandwiched between the tank lid 14 and the rim 22 of the tank 12. By this arrangement, both filters 28, 30 are held in position during operation of the vacuum cleaner 10, and the vacuum cleaner 10 can easily be opened and the filters 28, 30 removed for inspection and replacement.

The flow of air through the vacuum cleaner during ordinary operation is illustrated by arrows 76 in FIG. 2. Air is drawn into tank 12 through the air inlet 24 by action of the motor/impeller unit 16. The deflector shield 48 deflects the flow of incoming air, and the air then flows through the filter medium 38 of the primary filter 28, and then through float valve orifice 62 into cage base 34. The air then flows through filter medium 40 of the secondary filter 30, and is finally drawn up and through a discharge opening 78 at the side of the motor/impeller unit 16. Because the air flows through the primary filter 28 before flowing through the secondary filter 30, the secondary filter 30 is said to be downstream of the primary filter 28. Likewise, the secondary filter 30 is downstream of the float valve 64.

In the embodiment shown, a bypass design for the motor/impeller unit 16 is provided, in which the air is discharged at the side of the motor 18. In such a design a separate fan (not shown) is required to cool the motor 18. Alternatively, a flow-through design may be used, in which the air flows through the windings of the motor 18 and cools the motor 18 as it flows, and no separate cooling fan is required.

During operation of the vacuum cleaner 10, debris accumulates inside of tank 12, and dust and debris is filtered out of the flowing air by filters 28, 30, so that clean air is discharged from the discharge opening 78. As noted above, vacuum cleaner 10 may be a wet/dry vacuum cleaner, so that inlet 24 can draw in liquid and/or solid material, along with air. Valves such as the float valve 64 of the present invention are known to be useful in protecting the motor and impeller of a wet/dry vacuum cleaner from moisture by limiting the amount of liquid that can accumulate in the vacuum cleaner tank. As liquid accumulates in the tank 12, the liquid has a height or level in the tank 12. The level of the liquid may rise up in the tank 12 until the level of the liquid reaches the float ball 52. If additional material is drawn into the tank 12, then the float ball 52 floats on the liquid and rises as more liquid and/or solid material enters the tank 12. If the amount of material in the tank reaches the capacity of the tank, then the float ball 52 floats high enough to make contact with the float valve orifice 62. When this occurs, the vacuum cleaner is prevented from drawing in additional material though the inlet 24, and the operator of the vacuum cleaner 10 is alerted that the tank 12 needs to be emptied. Because the secondary filter 30 is downstream of the float valve 64, the float valve arrangement according to the present invention also serves an important second function. In addition to protecting the motor/impeller unit 16 from moisture, the float valve 64 also protects the secondary filter 30 from moisture, by inhibiting liquid from coming into contact with the secondary filter 30.

The present invention may be particularly advantageous when a HEPA filter is used as the secondary filter 30. HEPA filters may deteriorate when they become wet, so protection from moisture is desirable. The present invention also has the advantage of providing an arrangement whereby the two filters can easily be inspected and replaced. Because the filters 28, 30 are separate units, they may be separately inspected and replaced when necessary, an advantage compared to prior art dual-filter assemblies that include two filters in a single filter unit.

The foregoing detailed description has been given for clearness of understanding only, and no unnecessary limitations should be understood therefrom, as modifications would be obvious to those skilled in the art.

What is claimed is:

1. A vacuum cleaner having a dual filter assembly comprising:

a filter support;

a primary filter disposed on the filter support, the primary filter having an efficiency;

a secondary filter disposed downstream of the primary filter, the secondary filter having an efficiency higher than the efficiency of the primary filter; and a valve disposed downstream of the primary filter and upstream of the secondary filter for inhibiting liquid from coming into contact with the secondary filter.

2. A vacuum cleaner of claim 1 wherein the filter support comprises a filter cage.

3. A vacuum cleaner of claim 1 wherein the valve comprises a float valve.

4. A vacuum cleaner of claim 1 wherein the secondary filter is disposed on a second filter support.

5. A vacuum cleaner of claim 1 wherein the secondary filter is disposed in a cage base removably attached to a tank lid.

6. A vacuum cleaner of claim 5 wherein the cage base is attached to the tank lid by a plurality of clamps.

7. A vacuum cleaner of claim 5 wherein the cage base is disposed between the filter support and the tank lid.

8. The vacuum cleaner of claim 1 further comprising a filter retainer for retaining the primary filter on the filter support.

9. The vacuum cleaner of claim 1 wherein the secondary filter comprises a HEPA filter.

10. The vacuum cleaner of claim 1 wherein the valve comprises a float ball disposed in the filter cage.

11. A wet/dry vacuum cleaner comprising:

a first filter cage;

a cage base attached to the first filter cage;

a primary filter disposed on the first filter cage, the primary filter having an efficiency;

a secondary filter disposed on a second filter cage, inside of the cage base, downstream of the primary filter, the secondary filter having an efficiency higher than the efficiency of primary filter; and a float ball disposed inside of the first filter cage, downstream of the primary filter and upstream of the secondary filter, for inhibiting fluid from coming into contact with the secondary filter.

* * * * *